US005095831A

United States Patent [19]

Mauzy

[11] Patent Number: 5,095,831

[45] Date of Patent: Mar. 17, 1992

[54] SHOTGUN SHELL WITH MAGNETIZED PELLETS

[76] Inventor: Dave Mauzy, General Delivery, Cedar City, Mo. 65022

[21] Appl. No.: 717,371

[22] Filed: Jun. 19, 1991

[51] Int. Cl.[5] ..... F42B 7/04

[52] U.S. Cl. ..... 102/448; 102/457; 102/459; 102/501; 102/511; 102/517

[58] Field of Search ..... 102/448, 457, 459, 501, 102/511, 515

[56] References Cited

U.S. PATENT DOCUMENTS

| | | | |
|---|---|---|---|
| 3,363,561 | 1/1968 | Irons | 102/459 |
| 3,401,588 | 9/1968 | Olson | 102/448 |
| 3,598,057 | 8/1971 | Potter | 102/452 |
| 3,756,155 | 9/1973 | Smith | 102/457 |
| 4,169,904 | 9/1979 | Ferri | 102/457 |
| 4,222,330 | 9/1980 | Krystyniak | 102/501 |

*Primary Examiner*—Harold J. Tudor
*Attorney, Agent, or Firm*—Rogers, Howell & Haferkamp

[57] ABSTRACT

A shotgun shell loaded with steel shot utilizes a number of magnetized steel pellets intermixed in the load in order to form clusters of pellets as the load is discharged from the shell to thereby improve the shot pattern of relatively lightweight steel shot, steel being less dense than lead. The magnetized steel pellets may be either randomly mixed throughout the load or concentrated in one or more areas of the load. If concentrated in the middle of the load, a much larger cluster of shot is believed to be expelled from the gun barrel upon discharge of the shell. A Teflon TM or the like coating may be applied to the steel shot, or lubricants included in the load in order to lubricate the inside of the barrel and reduce any increased tendency of the magnetized shot to wear or abrate the barrel as the shot is discharged therefrom.

19 Claims, 1 Drawing Sheet

SHOTGUN SHELL WITH MAGNETIZED PELLETS

BACKGROUND AND SUMMARY OF THE INVENTION

Shotguns and shotgun shells have been used by hunters for many years. In the past, shotgun shells were loaded with a number of individual pellets which are propelled from the shotgun when the shell is discharged. As is well known in the art, these pellets are relatively small in size and desirably retain a close pattern as they are propelled towards a target in order that they will have maximum effectiveness. Although lead has been previously used for the pellets in shotgun shells, environmental concerns have dictated the discontinuing use of lead for pellets and ammunition manufacturers have substituted steel for the pellets. However, steel is not nearly as dense as lead and as a result the pattern density of the shot is not as close over comparable distances. This reduces the effectiveness and "clean killing range" of a steel pellet shotgun shell when compared to a lead pellet shotgun shell.

In response to this reduced effectiveness, ammunition manufacturers have been experimenting with other types of materials for pellets. Materials such as tungsten have been experimented with but those tests have been inconclusive. Furthermore, the increased cost of tungsten over the price of lead or steel makes shells significantly more expensive. This is similarly true with other kinds of substitute materials presently being experimented with and which are available in the market at these increased prices.

In order to improve the effectiveness of steel pellet shotgun shells and thereby render them more acceptable as a substitute for lead pellet shotgun shells, the inventor herein has succeeded in developing a technique for significantly improving the pattern density of steel shot with relatively little increased cost. This technique involves utilizing magnetic forces in the cluster of pellets in order to releasably unite a substantial portion of the pellets as the shell is discharged and the pellets are propelled through the gun barrel and in the direction of the target. The use of magnetic forces may take several different forms. In a first embodiment, a small number of magnetized pellets, made from chrome steel for example, may be intermixed with standard pellets (steel) such that they are arranged randomly throughout the load of the steel shot. This randomization of the magnetized pellets results in clusters of pellets as the shot is expelled from the shotgun. In an alternate embodiment, the magnetized pellets may be concentrated in the center of the load or in several portions of the load to thereby increase the magnetic field generated by the pellets. In still another embodiment, all of the pellets may be magnetized for those instances where the shells are being used for crowd control situations or other anti-personnel applications.

If the magnetized pellets are surrounded by standard steel pellets, the magnetic pellets will not as readily contact the inside of the gun barrel. This helps protect the interior gun barrel from the increased wear and potential scoring which might occur should the magnetic pellets come in direct contact therewith as the magnetic pellets are generally made from a harder grade of steel in order to better hold their magnetic polarity. In order to minimize the increased wear and potential scoring of the gun, a protective coating may be applied to the individual pellets, such as with silicone or Teflon TM (polytetrafluroethylene), to thereby provide a lubricant. Also, graphite could be used as well.

DETAILED DESCRIPTION OF THE PREFERRED EMBODIMENT

Figure 1:
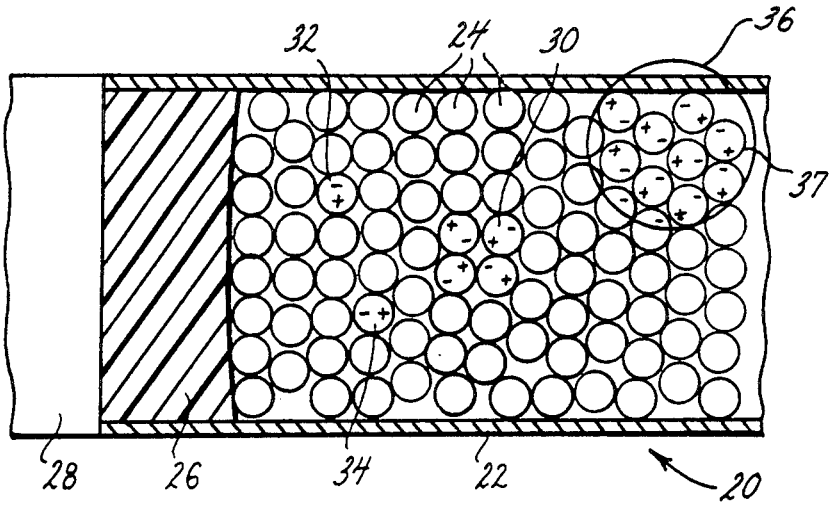
FIG. 1 is an enlarged partial cross-sectional view of a shotgun shell having pellets magnetized in accordance with the present invention.

As shown in FIG. 1, a shotgun shell 20 includes a casing 22, a plurality of steel shot 24, a plug 26 and a load of gunpowder 28, all as is well known in the art. However, in accordance with the teachings of the present invention, the steel shot 24 is magnetized prior to being loaded within the shell casing 22 so as to form clusters, as explained below. For example, a central cluster 30 may be formed, or the steel shot may be randomly spaced, as is exhibited by shot 32, 34, or clusters in other parts of the shell 22 may be formed by steel shot as shown at 36. The pellets which are magnetized can be distributed randomly throughout the shell, grouped and spaced throughout the shell or located substantially near the center of the shell. Also, the number of pellets magnetized may vary anywhere from just a few pellets up to substantially all of the pellets. Goods results have been obtained wherein about 50% of the pellets were magnetized and also 66% of the pellets were magnetized. Also as shown in the cluster at 36, each of the pellets may include a coating 37 of silicone and polytetrafluroethylene or the like which lubricates the shot and reduces the abrasive effect of the magnetized shot against the interior of the gun barrel.

Figure 2:
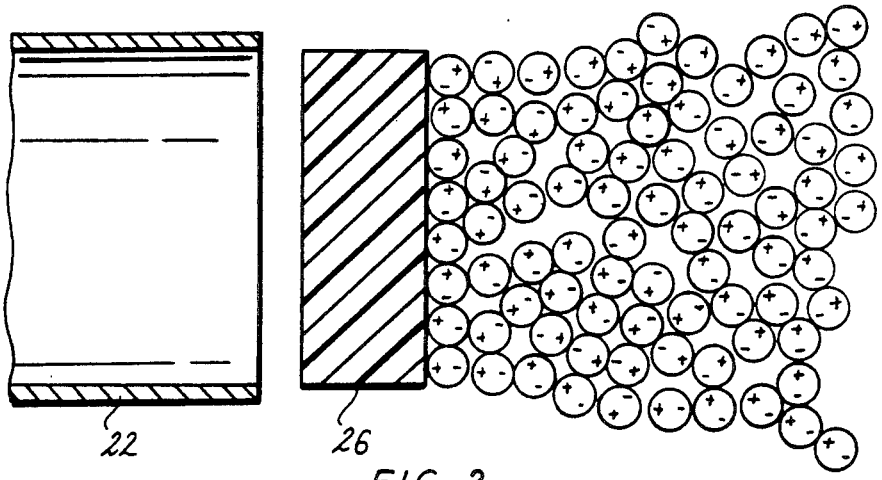
FIG. 2 is a partial cross-sectional view of the end of the shotgun shell after discharge showing release of the pellets from the shell casing.
Figure 3:
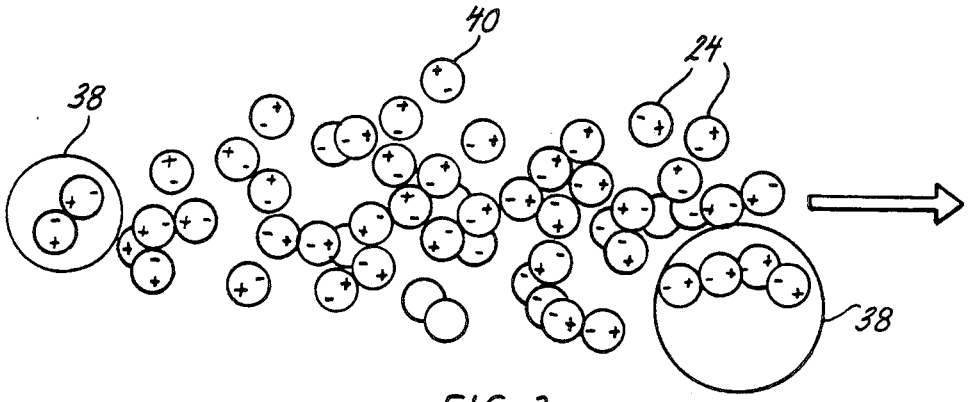
FIG. 3 is a side view of the various clusters of pellets formed with the magnetized pellets of the present invention.

As shown in FIGS. 2 and 3, when the shell is fired, the plug 26 is propelled through the shell casing 22 and the magnetized steel shot (shown in FIG. 2 as comprising all of the steel shot) remains in clusters as it exits the shell and travels towards the target, thereby improving the shot pattern to be substantially closer than is ordinarily experienced. As shown in FIG. 3, a substantial portion of the shot 24 remains in clusters, as shown at 38, although it is expected that some of the pellet shot or pellets with separate as shown at 40.

As explained above, the present invention comprises the use of magnetized steel pellets as part of the load of steel shot provided in an otherwise standard shotgun shell. These magnetized steel pellets may be a relatively small number of the total number of pellets included in a load, depending upon the size of the shot. Also, the magnetized pellets may be individually randomly located throughout the load, or they may be concentrated in the center of the load in order to provide different shot patterns with different loads. In tests, the inventor has found that concentrating the magnetized pellets in the central part of the load improved the results. Of course, the individual steel pellets may be magnetized in any conventional manner using any conventional means, all as is well known in the art. For example, the inventor has used chrome steel for the magnetized pellets in a series of tests. These magnetized pellets have been magnetized by placing them in contact with a large permanent magnet and in its magnetic field to thereby impart a magnetic field thereto. The inventor has succeeded in doubling the amount of shot which will hit within a 12" circular shot pattern at a range of 45 yards using the present invention. Tests have shown increasingly better results as up to 50% of the pellets are magnetized pellets. The inventor believes further improved performance would be experienced for up to 66% of the total load being magnetized in the center.

In order to minimize any additional or increased wearing of the inside of the gun barrel resulting from the generally somewhat harder magnetized pellets and their clumping propensity, a silicone or Teflon TM coating may be added to the shot which helps to protect and lubricate the inside of the gun barrel as the shot is discharged therethrough. Additionally, graphite could be used as a lubricant, or any other similar substance as would be well known to one of ordinary skill in the art.

With the magnetized pellets as part of the steel shot load, dispersal of the shot otherwise caused by friction and the shearing effect is diminished and the shot has a tendency to stay in a much tighter pattern over an equivalent distance for unmagnetized shot. It is believed that the steel pellets cling together in releasable fashion for some distance after they are expelled from the gun barrel and that this aids in "directing" the shot along the same line of flight as adjacent shot in the same load. It is also noted that protective wadding should be used in conjunction with the magnetized steel pellets.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a shotgun shell having a plurality of metallic pellets therein, substantially all of said metallic pellets being comprised substantially of magnetizable material, the improvement comprising at least some of said metallic pellets being magnetized to thereby help retain said plurality of metallic pellets in a substantially tight pattern as the shell is discharged.

2. The device of claim 1 wherein said magnetized metallic pellets are distributed substantially randomly throughout said plurality of pellets.

3. The device of claim 1 wherein said magnetized metallic pellets are substantially concentrated in at least one portion of the pellets.

4. The device of claim 3 wherein said at least one portion is only the central portion of said plurality of metallic pellets.

5. The device of claim 1 wherein at least a portion of said plurality of metallic pellets has a non-metallic coating applied thereto.

6. The device of claim 5 wherein said coating is made of silicone.

7. The device of claim 5 wherein said coating is made of polytetrafluroethylene.

8. The device of claim 5 wherein said coating has means for lubricating said metallic pellets to thereby reduce their propensity for abrating the inside of shotgun barrels when discharged therethrough.

9. The device of claim 4 wherein about 50% of said metallic pellets are magnetized pellets.

10. The device of claim 4 wherein up to 66% of said metallic pellets are magnetized pellets.

11. The device of claim 1 wherein substantially all of the metallic pellets are magnetized.

12. In a shotgun shell having a plurality of magnetically attractive metallic pellets therein, substantially all of said metallic pellets being comprised substantially of magnetizable material, the improvement comprising means for releasably uniting substantially all of said plurality of pellets to thereby maintain said metallic pellets in a substantially close pattern as said metallic pellets are propelled by said shell being discharged, said releasable uniting means comprising a number of magnetized pellets intermixed with non-magnetized pellets to thereby comprise said plurality of metallic pellets.

13. The device of claim 12 wherein said magnetized metallic pellets are distributed substantially randomly throughout said plurality of metallic pellets.

14. The device of claim 12 wherein said magnetized metallic pellets are collected into groups spaced throughout said plurality of metallic pellets.

15. The device of claim 12 wherein said magnetized metallic pellets are collected substantially near the center of said plurality of metallic pellets.

16. The device of claim 12 wherein a substantial portion of said plurality of metallic pellets is each covered with a coating for protecting and lubricating the metallic pellets against the inside of a gun barrel as the shell is discharged.

17. The device of claim 15 wherein up to 50% of said metallic pellets are magnetized metallic pellets.

18. The device of claim 15 wherein up to 66% of said metallic pellets are magnetized pellets.

19. The device of claim 12 wherein said releasable uniting means comprises said substantially all of said plurality of metallic pellets being magnetized.

* * * * *